US010207509B2

(12) United States Patent
Odaka et al.

(10) Patent No.: US 10,207,509 B2
(45) Date of Patent: Feb. 19, 2019

(54) LIQUID DISCHARGE HEAD, LIQUID DISCHARGE DEVICE, AND LIQUID DISCHARGE APPARATUS

(71) Applicants: Toshimichi Odaka, Kanagawa (JP); Takahiro Yoshida, Ibaraki (JP); Takayuki Nakai, Kanagawa (JP)

(72) Inventors: Toshimichi Odaka, Kanagawa (JP); Takahiro Yoshida, Ibaraki (JP); Takayuki Nakai, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 8 days.

(21) Appl. No.: 15/258,394

(22) Filed: Sep. 7, 2016

(65) Prior Publication Data

US 2017/0096015 A1 Apr. 6, 2017

(30) Foreign Application Priority Data

Oct. 1, 2015 (JP) ..... 2015-196064
Jun. 30, 2016 (JP) ..... 2016-129659

(51) Int. Cl.

| | |
|---|---|
| ***B41J 2/17*** | (2006.01) |
| ***B41J 2/18*** | (2006.01) |
| ***B41J 2/185*** | (2006.01) |
| ***B41J 2/175*** | (2006.01) |

(52) U.S. Cl.

CPC ..... *B41J 2/1707* (2013.01); *B41J 2/175* (2013.01); *B41J 2/17509* (2013.01); *B41J 2/18* (2013.01); *B41J 2/185* (2013.01); *B41J 2002/1856* (2013.01)

(58) Field of Classification Search

CPC ..... B41J 2/1707; B41J 2/17509; B41J 2/175; B41J 2/18; B41J 2/185; B41J 2002/1856

See application file for complete search history.

(56) References Cited

U.S. PATENT DOCUMENTS

2003/0016256 A1* 1/2003 Harvey ..... B41J 2/14201 347/10
2012/0092417 A1* 4/2012 Kumagai ..... B41J 2/14274 347/47
2015/0306875 A1 10/2015 Nishimura et al.

FOREIGN PATENT DOCUMENTS

JP 2004-074605 3/2004
WO WO2001/08888 A1 2/2001

OTHER PUBLICATIONS

U.S. Appl. No. 14/988,379, filed Jan. 5, 2016.

* cited by examiner

*Primary Examiner* — Justin Seo
(74) *Attorney, Agent, or Firm* — Cooper & Dunham LLP

(57) ABSTRACT

A liquid discharge head includes a nozzle, an individual liquid chamber, and a circulation channel. The nozzle discharges liquid. The individual liquid chamber is communicated with the nozzle. The circulation channel is communicated with the individual liquid chamber. A first direction in which liquid flows in the individual liquid chamber crosses a second direction in which liquid flows in the circulation channel. A liquid-inflow-side opening of the nozzle faces an area in which a flow of liquid changes from the first direction to the second direction.

13 Claims, 12 Drawing Sheets

LIQUID DISCHARGE HEAD, LIQUID DISCHARGE DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application Nos. 2015-196064 filed on Oct. 1, 2015 and 2016-129659 filed on Jun. 30, 2016 in the Japan Patent Office, the entire disclosure of each of which is hereby incorporated by reference herein.

BACKGROUND

Technical Field

Aspects of the present disclosure relate to a liquid discharge head, a liquid discharge device, and a liquid discharge apparatus.

Related Art

As a liquid discharge head (droplet discharge head) to discharge liquid, for example, a circulation-type head is known that circulates liquid in a plurality of individual liquid chambers.

Such liquid circulation in the liquid discharge head is performed to prevent a change in properties of liquid due to, for example, drying.

SUMMARY

In an aspect of the present disclosure, there is provided a liquid discharge head that includes a nozzle, an individual liquid chamber, and a circulation channel. The nozzle discharges liquid. The individual liquid chamber is communicated with the nozzle. The circulation channel is communicated with the individual liquid chamber. A first direction in which liquid flows in the individual liquid chamber crosses a second direction in which liquid flows in the circulation channel. A liquid-inflow-side opening of the nozzle faces an area in which a flow of liquid changes from the first direction to the second direction.

In another aspect of the present disclosure, there is provided a liquid discharge device that includes the liquid discharge head to discharge liquid.

In still another aspect of the present disclosure, there is provided a liquid discharge apparatus that includes the liquid discharge device to discharge liquid.

In still yet another aspect of the present disclosure, there is provided a liquid discharge apparatus that includes the liquid discharge head to discharge liquid.

In still yet another aspect of the present disclosure, there is provided a liquid discharge head that includes a nozzle, an individual liquid chamber, a nozzle passage, and a circulation channel. The nozzle discharges liquid. The individual liquid chamber is communicated with the nozzle. The nozzle passage communicates the individual liquid chamber with the nozzle. The circulation channel is communicated with the nozzle passage. A first direction in which liquid flows in the nozzle passage crosses a second direction in which liquid flows in the circulation channel. A liquid-inflow-side opening of the nozzle faces a boundary portion between the nozzle passage and the circulation channel. A portion of the liquid-inflow-side opening of the nozzle opposes the nozzle passage.

In still yet another aspect of the present disclosure, there is provided a liquid discharge head that includes a nozzle, an individual liquid chamber, and a circulation channel. The nozzle discharges liquid. The individual liquid chamber is communicated with the nozzle. The circulation channel is communicated with the individual liquid chamber. A first direction in which liquid flows in the individual liquid chamber crosses a second direction in which liquid flows in the circulation channel. A liquid-inflow-side opening of the nozzle opposes a circulation-channel-side area of the individual liquid chamber including a central position of the individual liquid chamber in a direction perpendicular to the first direction.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
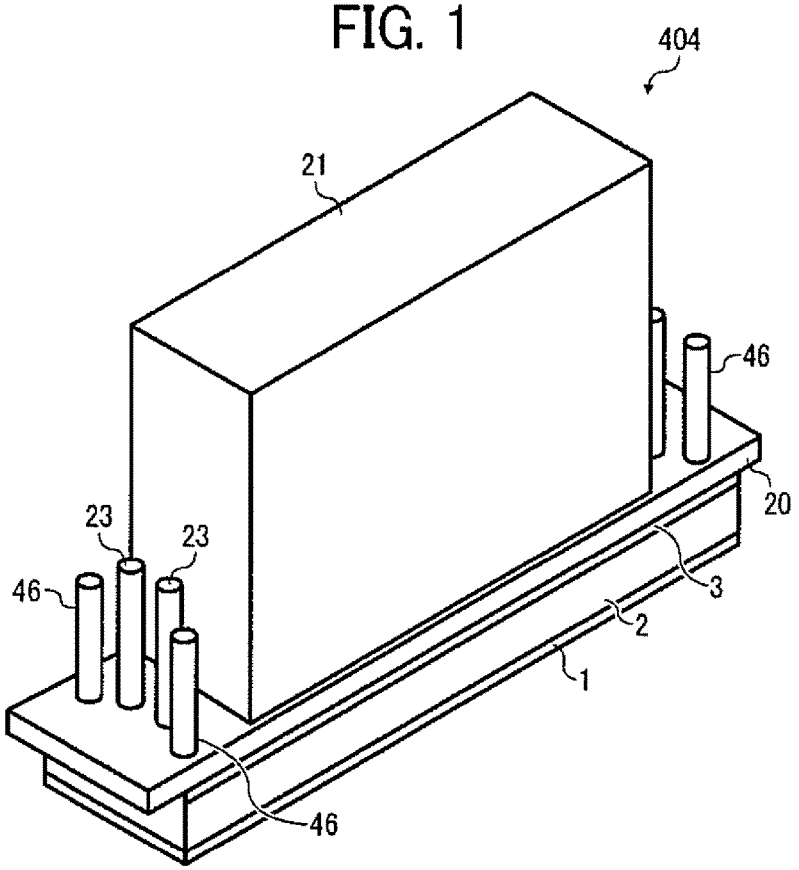
FIG. 1 is an outer perspective view of a liquid discharge head according to a first embodiment of the present disclosure.

The accompanying drawings are intended to depict embodiments of the present disclosure and should not be interpreted to limit the scope thereof The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manlier and achieve similar results.

Although the embodiments are described with technical limitations with reference to the attached drawings, such description is not intended to limit the scope of the disclosure and all of the components or elements described in the embodiments of this disclosure are not necessarily indispensable.

Figure 2:
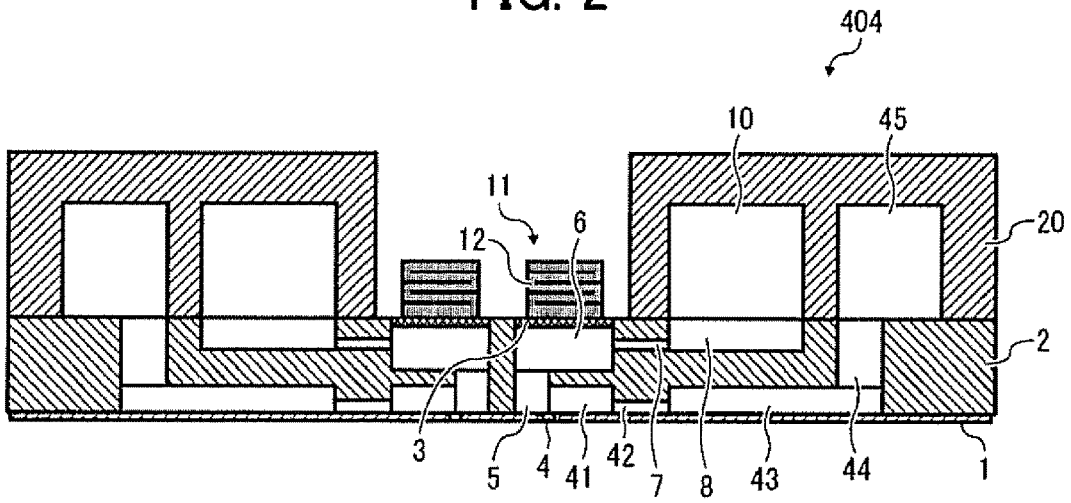
FIG. 2 is a cross-sectional view of the liquid discharge head of FIG. 1, cut in a direction (a longitudinal direction of an individual liquid chamber) perpendicular to a nozzle array direction in which nozzles are arrayed in row.
Figure 3:
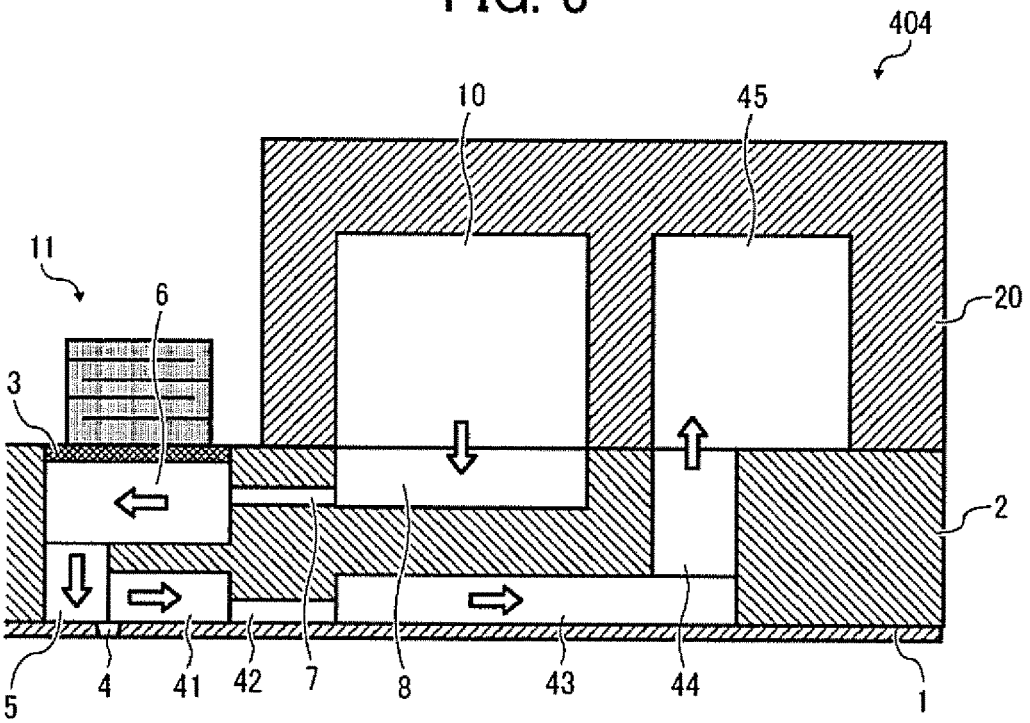
FIG. 3 is an enlarged cross-sectional view of a portion of the liquid discharge head illustrated in FIG. 2, cut in the nozzle array direction.

Hereinafter, embodiments of the present disclosure are described with reference to the attached drawings. A liquid discharge head according to a first embodiment of the present disclosure is described with reference to FIGS. 1 to 3. FIG. 1 is an outer perspective view of the liquid discharge head according to the first embodiment. FIG. 2 is a cross-sectional view of the liquid discharge head of FIG. 1, cut in a direction (a longitudinal direction of an individual liquid chamber) perpendicular to a nozzle array direction in which nozzles are arrayed in row. FIG. 3 is an enlarged cross-sectional view of a portion of the liquid discharge head illustrated in FIG. 2, cut in the nozzle array direction.

A liquid discharge head 404 according to the first embodiment of the present disclosure includes a nozzle plate 1, a channel plate 2, and a diaphragm plate 3 as a wall member that are laminated one on another and bonded to each other. The liquid discharge head 404 includes piezoelectric actuators 11 to displace the diaphragm plate 3, a frame member 20 as a common-liquid-chamber substrate, and a cover 21.

The nozzle plate 1 includes a plurality of nozzles 4 to discharge liquid. In the first embodiment, the nozzle plate 1 includes two nozzles rows, each of which the plurality of nozzles 4 is arrayed in row in a longitudinal direction of the nozzle plate 1.

The channel plate 2 includes nozzle passages 5 communicated with the nozzles 4, individual liquid chambers 6 communicated with the nozzle passages 5, supply-channel-side fluid restrictors 7 communicated with the individual liquid chambers 6, through-holes and grooves forming liquid inlets (liquid passages) 8 communicated with the supply-channel-side fluid restrictors 7. The supply-channel-side fluid restrictor 7 and the liquid inlet 8 constitutes a liquid supply channel.

The diaphragm plate 3 is a deformable wall member forming a wall of each of the individual liquid chambers 6 of the channel plate 2.

At a first side of the diaphragm plate 3 opposite a second side of the diaphragm plate 3 facing the individual liquid chambers 6, the piezoelectric actuators 11 including electromechanical transducer elements as drivers (actuators or pressure generators) are disposed to deform the diaphragm plate 3.

For the piezoelectric actuator 11, laminated piezoelectric members are groove-processed by half cut dicing so that a plurality of pillar-shaped piezoelectric elements (piezoelectric pillars) 12 are formed at predetermined intervals in the nozzle array direction to have a comb shape. The piezoelectric elements 12 are bonded to the diaphragm plate 3.

The frame member 20 includes the common liquid chambers 10 to which liquid is supplied from head tanks and liquid cartridges.

The channel plate 2 includes grooves forming circulation liquid chambers 41, circulation-channel-side fluid restrictors 42, and delivery channels 43. The circulation liquid chambers 41 are communicated with the nozzle passage 5 and disposed at a first side of the channel plate 2 facing the nozzle plate 1 opposite a second side of the channel plate 2 facing the individual liquid chambers 6. The circulation-channel-side fluid restrictors 42 are communicated with the circulation liquid chambers 41. The delivery channels 43 are communicated with the circulation-channel-side fluid restrictors 42. The delivery channels 43 are communicated circulation common-liquid chambers 45 in the frame member 20 via passages 44 formed by through-holes. Note that a channel from the circulation liquid chamber 41 to the circulation common-liquid chamber 45 constitutes a circulation channel.

The frame member 20 includes supply ports 23 communicated with the common liquid chambers 10 and circulation ports (delivery ports) 46 communicated with the circulation common-liquid chambers 45.

In the liquid discharge head 404 thus configured, for example, when a voltage lower than a reference potential is applied to the piezoelectric element 12, the piezoelectric element 12 contracts. Accordingly, the diaphragm plate 3 is pulled and the volume of the individual liquid chamber 6 increases, thus causing liquid to flow into the individual liquid chamber 6.

When the voltage applied to the piezoelectric element 12 is raised, the piezoelectric element 12 extends in a direction of lamination in which the laminated piezoelectric members of the piezoelectric element 12 are laminated one on another. Accordingly, the diaphragm plate 3 deforms in a direction toward the nozzle 4 and the volume of the individual liquid chamber 6 reduces. Thus, liquid in the individual liquid chamber 6 is pressurized and discharged from the nozzle 4.

When the voltage applied to the piezoelectric element 12 is returned to the reference potential, the diaphragm plate 3 is returned to the initial position. Accordingly, the individual liquid chamber 6 expands to generate a negative pressure, thus replenishing liquid from the common liquid chamber 10 into the individual liquid chamber 6. After the vibration of a meniscus surface of the nozzle 4 decays to a stable state, the liquid discharge head 404 shifts to an operation for the next droplet discharge.

Note that the driving method of the liquid discharge head 404 is not limited to the above-described example (pull-push discharge). For example, pull discharge or push discharge may be performed in accordance with the way to apply a drive waveform.

Figure 4:
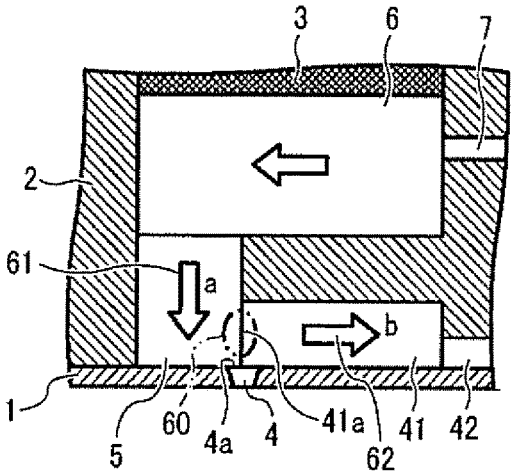
FIG. 4 is an enlarged cross-sectional view of a portion of the liquid discharge head illustrated in FIG. 3.

Next, the flow of liquid and the positions of the nozzles in the liquid discharge head according to an embodiment are described with reference to FIG. 4. FIG. 4 is an enlarged cross-sectional view of a portion of the liquid discharge head illustrated in FIG. 3.

The liquid discharge head 404 includes the nozzle passages 5 and the circulation liquid chambers 41. As illustrated in FIG. 4, the nozzle passage 5 connects he individual liquid chamber 6 to the nozzle 4 to flow liquid toward the nozzle 4. The circulation liquid chamber 41 flows liquid in a direction crossing a direction of flow of liquid in the nozzle passage 5 (in this example, in a direction perpendicular to the direction of flow of liquid in the nozzle passage 5).

Here, a first direction a represents a direction of flow of liquid in the nozzle passage 5, indicated by arrow 61 in FIG. 4, from the individual liquid chamber 6 toward the nozzle 4 through the nozzle passage 5. A second direction b represents a direction of flow of liquid in the circulation liquid chamber 41, indicated by arrow 62 in FIG. 4. The first direction a crosses the second direction b. In the present embodiment, the nozzle passage 5 and the circulation liquid chamber 41 are disposed so that the first direction a is perpendicular to the second direction b.

An opening 41*a* of a liquid inflow side of the circulation liquid chamber 41 is communicated with the nozzle passage 5. A liquid-inflow-side opening 4*a* of the nozzle 4 faces a boundary portion 60 between the nozzle passage 5 and the circulation liquid chamber 41. A portion of the liquid-inflow-side opening 4*a* opposes (faces) the nozzle passage 5, and the remainder portion of the liquid-inflow-side opening 4*a* opposes (faces) the circulation liquid chamber 41.

Accordingly, the liquid-inflow-side opening 4*a* of the nozzle 4 faces an area (the boundary portion 60) in which the direction of flow of liquid changes from the first direction a to the second direction b. The area that the liquid-inflow-side opening 4*a* of the nozzle 4 faces includes an area in which the direction of flow of liquid entirely turns to the second direction b (an area opposing the circulation liquid chamber 41).

With such a configuration, as indicated by arrows in FIGS. 3 and 4, liquid is supplied from the common liquid chamber 10 to the individual liquid chamber 6 through the supply-channel-side fluid restrictor 7 and flows from the individual liquid chamber 6 toward the nozzle 4 via the nozzle passage 5.

In the present embodiment, the direction of flow of liquid from the nozzle passage 5 is turned to the circulation liquid chamber 41 by 90° and liquid flows to the circulation common-liquid chamber 45 through the circulation-channel-side fluid restrictor 42, the delivery channel 43, and the passage 44.

Figure 5:
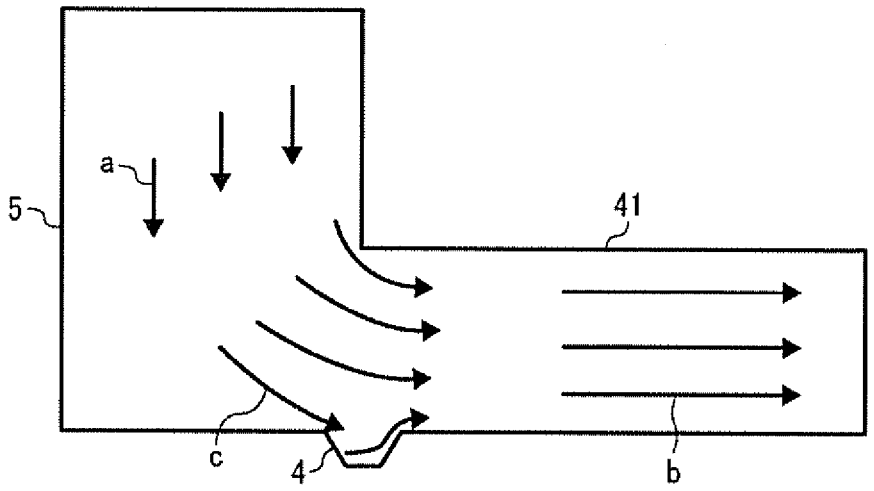
FIG. 5 is an illustration of an enlarged cross sectional view of the liquid discharge head illustrated in FIG. 4.

As illustrated in FIG. 5, when the direction of flow of liquid is turned from the first direction a to the second direction b crossing the first direction a during circulation, such a configuration facilitates flowing of liquid from the first direction a into the nozzle 4.

In the present embodiment, the cross-sectional open area of the circulation liquid chamber 41 is smaller than the cross-sectional open area of the nozzle passage 5. The speed of flow of liquid is faster in the second direction b than the speed in the first direction a. The nozzle 4 is disposed immediately upstream from a turning point, at which the speed of flow changes from the speed in the first direction a to the faster speed in the second direction b, in the direction of flow of liquid. Such a configuration facilitates liquid to flow from the first direction a into the nozzle 4.

Such a configuration also facilitates liquid in the nozzle 4 to be scraped out by a flow of liquid in a turning direction c from the first direction a to the second direction b.

Thus, liquid in the nozzle 4 is more likely to be stirred.

Figure 6:
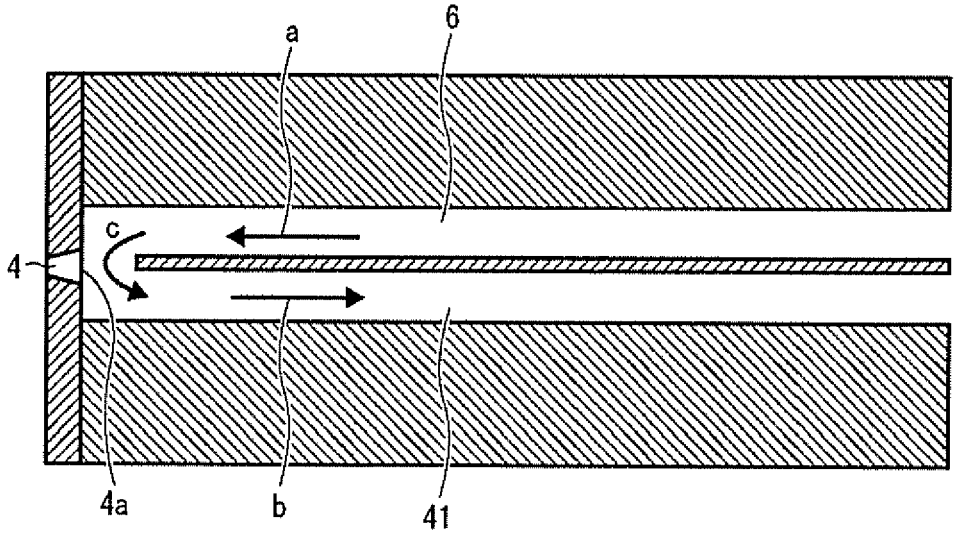
FIG. 6 is an illustration of a comparative example.

Below, a comparative example is described with reference to FIG. 6. FIG. 6 is an illustration of the comparative example.

For the comparative example, the individual liquid chamber 6 side and the circulation liquid chamber 41 are disposed side by side so that the first direction a is opposite the second direction b. The liquid-inflow-side opening 4*a* of the nozzle 4 is disposed opposing both the individual liquid chamber 6 and the circulation liquid chamber 41.

In the configuration of the comparative example, the liquid-inflow-side opening 4*a* of the nozzle 4 is disposed at a position outside the turning direction c in which the flow of liquid makes a U-turn from the individual liquid chamber 6 to the circulation liquid chamber 41. Accordingly, liquid flows in such a manner that liquid touches an inner side of the nozzle 4. As a result, liquid in the nozzle 4 is not scraped out, thus hampering stirring of liquid in the nozzle 4.

Hence, the above-described embodiment of the present disclosure facilitates stirring of liquid in the nozzle 4, thus reducing a change in properties of liquid due to, for example, drying.

In the present embodiment, the circulation channel includes the circulation-channel-side fluid restrictor 42 downstream from the nozzle 4 in the direction of flow of liquid. The fluid resistance of the nozzle 4 (the resistance of the nozzle 4 against the flow of liquid) is smaller than the fluid resistance of the circulation-channel-side fluid restrictor 42.

Such a configuration increases the energy efficiency in discharging liquid from the nozzle 4. In addition, such a smaller fluid resistance of the nozzle 4 facilitates inflow of liquid to the nozzle 4.

In the present embodiment, the cross-sectional open area of the circulation liquid chamber 41 is smaller than the cross-sectional open area of the nozzle passage 5 being a channel through which liquid flows from The individual liquid chamber 6 toward the nozzle 4.

Such a configuration increases the speed of flow of liquid, thus facilitating stirring of liquid.

Figure 7:
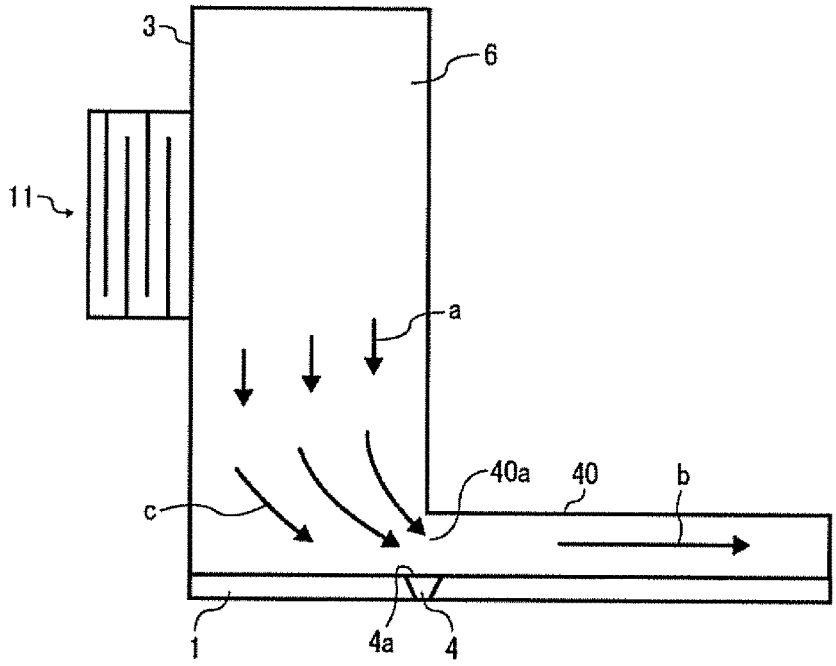
FIG. 7 is an illustration of a portion of the liquid discharge head according to a second embodiment of the present disclosure.

Next, a liquid discharge head according to a second embodiment of the present disclosure is described with reference to FIG. 7. FIG. 7 is an illustration of a portion of the liquid discharge head 404 according to the second embodiment.

In the second embodiment, a liquid-inflow-side opening 40*a* of a circulation channel 40 is communicated with a side wall of the individual liquid chamber 6.

In the second embodiment, the first direction a represents a direction of flow of liquid in the individual liquid chamber 6, indicated by arrow a in FIG. 7. The second direction b represents a direction of flow of liquid in the circulation channel 40 indicated by arrow b in FIG. 7. The first direction a crosses the second direction b. In the second embodiment, the individual liquid chamber 6 and the circulation channel 40 are disposed so that the first direction a is perpendicular to the second direction b.

The liquid-inflow-side opening 4*a* of the nozzle 4 faces a boundary portion between the individual liquid chamber 6 and the circulation channel 40. A portion of the liquid-inflow-side opening 4*a* opposes (faces) the individual liquid chamber 6, and the remainder portion of the liquid-inflow-side opening 4*a* opposes (faces) the circulation channel 40.

Accordingly, the liquid-inflow-side opening 4*a* of the nozzle 4 faces an area (the boundary portion) in which the direction of flow of liquid changes from the first direction a to the second direction b. The area in which the liquid-inflow-side opening 4*a* of the nozzle 4 faces includes an area in which the direction of flow of liquid entirely turns to the second direction b (an area opposing the circulation channel 40).

As in the above-described first embodiment, when the direction of flow of liquid is turned from the first direction a to the second direction b crossing the first direction a during circulation, such a configuration facilitates flowing of liquid from the first direction a into the nozzle 4, thus facilitating stirring of liquid in the nozzle 4.

Figure 8:
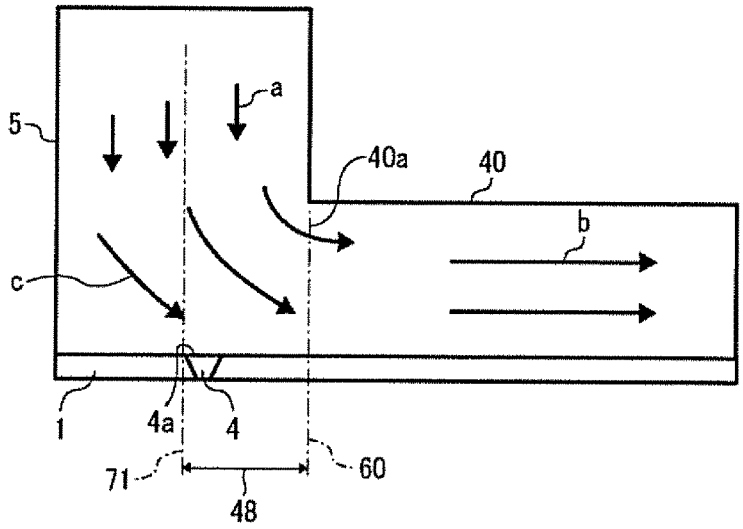
FIG. 8 is an illustration of a portion of the liquid discharge head according to a third embodiment of the present disclosure.

Next, the liquid discharge head according to a third embodiment of the present disclosure is described with reference to FIG. 8. FIG. 8 is an illustration of a portion of the liquid discharge head according to the third embodiment.

In the third embodiment, the liquid-inflow-side opening 40*a* of a circulation channel 40 is communicated with a side wall of the nozzle passage 5.

In the third embodiment, the first direction a represents a direction of flow of liquid in the nozzle passage 5, indicated by arrow a in FIG. 8. The second direction b represents a direction of flow of liquid in the circulation channel 40, indicated by arrow b in FIG. 8. The first direction a crosses the second direction b. In the third embodiment, the nozzle passage 5 and the circulation channel 40 are disposed so that the first direction a is perpendicular to the second direction b.

The liquid-inflow-side opening 4*a* of the nozzle 4 is disposed at a position at which at least a portion of the liquid-inflow-side opening 4*a* faces a circulation-channel-side area 48 of the nozzle passage 5 closer to the circulation channel 40 including a central position 71 in a direction perpendicular to the direction of flow of liquid (the first direction a). In the third embodiment, the liquid-inflow-side opening 4*a* of the nozzle 4 is disposed at a position entirely opposing the nozzle passage 5 and closest to the central position 71.

When the direction of flow of liquid is turned from the first direction a to the second direction b crossing the first direction a during circulation, such a configuration facilitates flowing of liquid from the first direction a into the nozzle 4, thus facilitating stirring of liquid in the nozzle 4.

Figure 9:
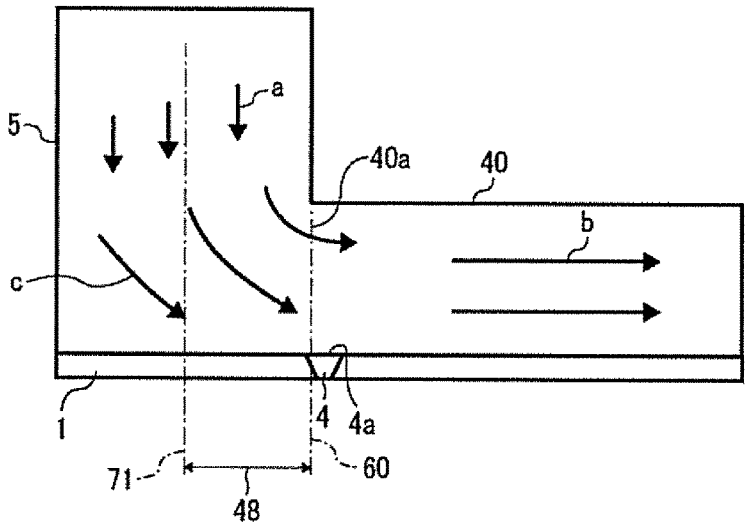
FIG. 9 is an illustration of a portion of the liquid discharge head according to a fourth embodiment of the present disclosure.

Next, the liquid discharge head according to a fourth embodiment of the present disclosure is described with reference to FIG. 9. FIG. 9 is an illustration of a portion of the liquid discharge head according to the fourth embodiment.

For the present embodiment, in the configuration of the above-described third embodiment, the nozzle 4 is disposed at a position at which the liquid-inflow-side opening 4*a* strides over the boundary portion 60. A portion of the liquid-inflow-side opening 4*a* of the nozzle 4 opposes the nozzle passage 5, and the remainder portion of the liquid-inflow-side opening 4*a* opposes the circulation channel 40.

Here, the liquid-inflow-side opening 4*a* of the nozzle 4 is disposed at a position at which an area opposing the circulation channel 40 is greater than an area opposing the nozzle passage 5 in the direction perpendicular to the first direction a.

As in the above-described first embodiment, when the direction of flow of liquid is turned from the first direction a to the second direction b crossing the first direction a during circulation, such a configuration facilitates flowing of liquid from the first direction a into the nozzle 4, thus facilitating stirring of liquid in the nozzle 4.

Figure 10:
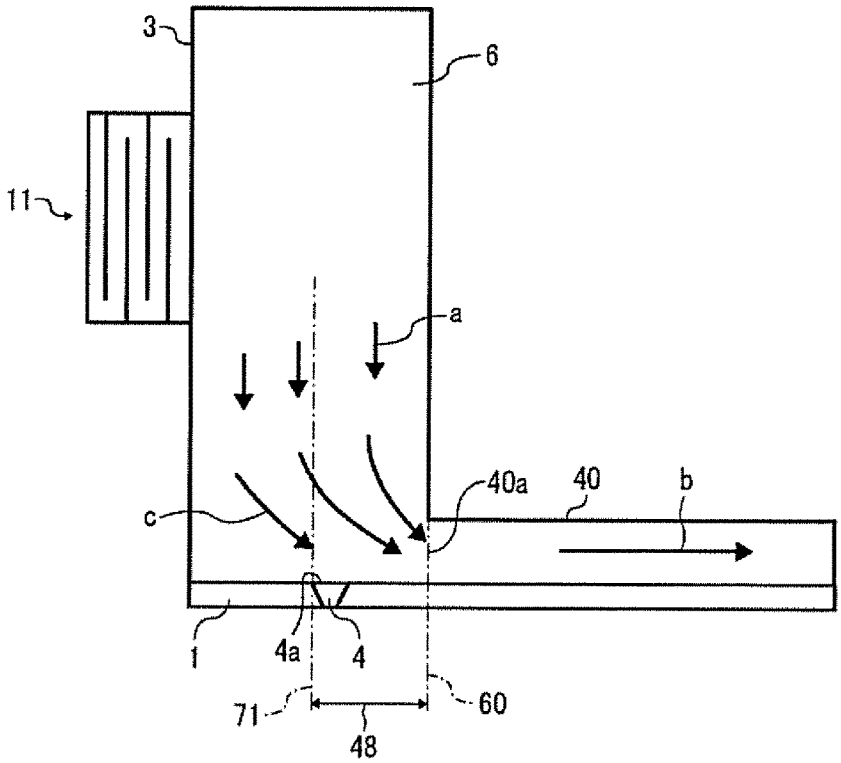
FIG. 10 is an illustration of a portion of the liquid discharge head according to a fifth embodiment of the present disclosure.

Next, the liquid discharge head according to a fifth embodiment of the present disclosure is described with reference to FIG. 10. FIG. 10 is an illustration of a portion of the liquid discharge head according to the fifth embodiment.

In the fifth embodiment, the liquid-inflow-side opening 40*a* of the circulation channel 40 is communicated with a side wall of the individual liquid chamber 6.

In the fifth embodiment, the first direction a represents a direction of flow of liquid in the individual liquid chamber 6, indicated by arrow a in FIG. 10. The second direction b represents a direction of flow of liquid in the circulation channel 40 indicated by arrow b in FIG. 10. The first direction a crosses the second direction b. In the fifth embodiment, the individual liquid chamber 6 and the circulation channel 40 are disposed so that the first direction a is perpendicular to the second direction b.

The liquid-inflow-side opening 4*a* of the nozzle 4 is disposed at a position at which at least a portion of the liquid-inflow-side opening 4*a* faces a circulation-channel-side area 48 of the individual liquid chamber 6 closer to the circulation channel 40 including a central position 71 in a direction perpendicular to the direction of flow of liquid (the first direction a). In the third embodiment, the liquid-inflow-side opening 4*a* of the nozzle 4 is disposed at a position entirely opposing the individual liquid chamber 6 and closest to the central position 71.

When the direction of flow of liquid is turned from the first direction a to the second direction b crossing the first direction a during circulation, such a configuration facilitates flowing of liquid from the first direction a into the nozzle 4, thus facilitating stirring of liquid in the nozzle 4.

Figure 11:
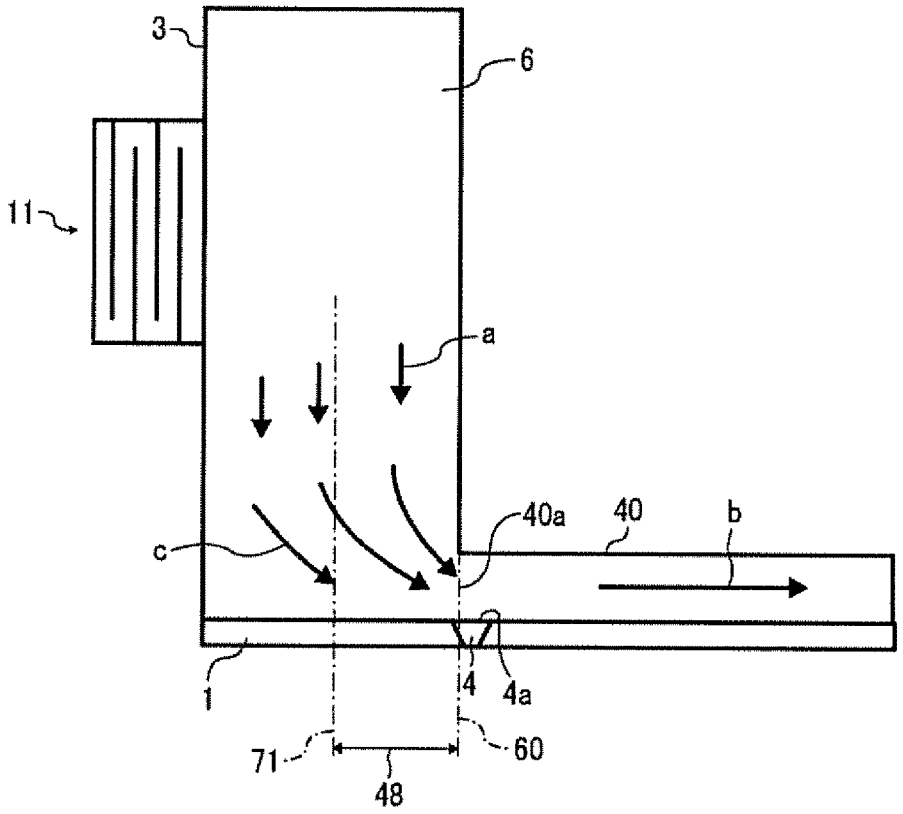
FIG. 11 is an illustration of a portion of the liquid discharge head according to a sixth embodiment of the present disclosure.

Next, the liquid discharge head according to a sixth embodiment of the present disclosure is described with reference to FIG. 11. FIG. 11 is an illustration of a portion of the liquid discharge head according to the sixth embodiment.

For the sixth embodiment, in the configuration of the above-described fifth embodiment, the nozzle 4 is disposed at a position at which the liquid-inflow-side opening 4*a* strides over the boundary portion 60. A portion of the liquid-inflow-side opening 4*a* of the nozzle 4 opposes the individual liquid chamber 6, and the remainder portion of the liquid-inflow-side opening 4*a* opposes the circulation channel 40.

Here, the liquid-inflow-side opening 4*a* of the nozzle 4 is disposed at a position at which an area opposing the circulation channel 40 is greater than an area opposing the individual liquid chamber 6 in the direction perpendicular to the first direction a.

As in the above-described first embodiment, when the direction of flow of liquid is turned from the first direction a to the second direction b crossing the first direction a during circulation, such a configuration facilitates flowing of liquid from the first direction a into the nozzle 4, thus facilitating stirring of liquid in the nozzle 4.

Figure 12:
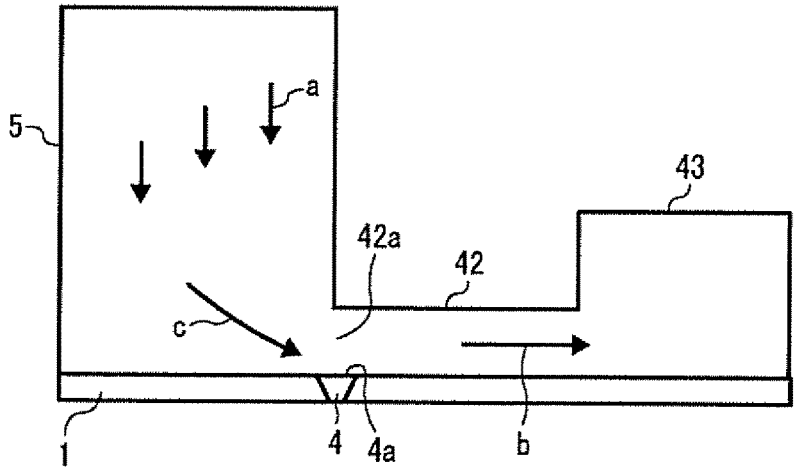
FIG. 12 is an illustration of a portion of the liquid discharge head according to a seventh embodiment of the present disclosure.

Next, the liquid discharge head according to a seventh embodiment of the present disclosure is described with reference to FIG. 12. FIG. 12 is an illustration of a portion of the liquid discharge head according to the seventh embodiment.

In the seventh embodiment, a liquid-inflow-side opening 42*a* of the circulation-channel-side fluid restrictor 42 as the circulation channel is communicated with a side wall of the nozzle passage 5. The liquid-inflow-side opening 42*a* is also a liquid-inflow-side opening of the circulation channel (the liquid-inflow-side opening 40*a* in the third embodiment).

In the seventh embodiment, the first direction a represents a direction of flow of liquid in the nozzle passage 5, indicated by arrow a in FIG. 12. The second direction b represents a direction of flow of liquid in the circulation-channel-side fluid restrictor 42, indicated by arrow b in FIG. 12. The first direction a crosses the second direction b. In the fifth embodiment, the nozzle passage 5 and the circulation-channel-side fluid restrictor 42 are disposed so that the first direction a is perpendicular to the second direction b.

A portion of the liquid-inflow-side opening 4*a* of the nozzle 4 opposes the nozzle passage 5, and the remainder portion of the liquid-inflow-side opening 4*a* opposes the circulation-channel-side fluid restrictor 42.

In the seventh embodiment, the length of the circulation-channel-side fluid restrictor 42 in the second direction b is longer than the diameter of the liquid-inflow-side opening 4*a* of the nozzle 4. Accordingly, when the direction of flow of liquid is turned from the first direction a to the second direction b crossing the first direction a, the cross-sectional area of the channel decreases, thus increasing the speed of flow.

Such a configuration facilitates flowing of liquid into the nozzle 4, of which the liquid-inflow-side opening 4*a* opposes the circulation-channel-side fluid restrictor 42, thus facilitating stirring of liquid in the nozzle 4.

Figure 13:
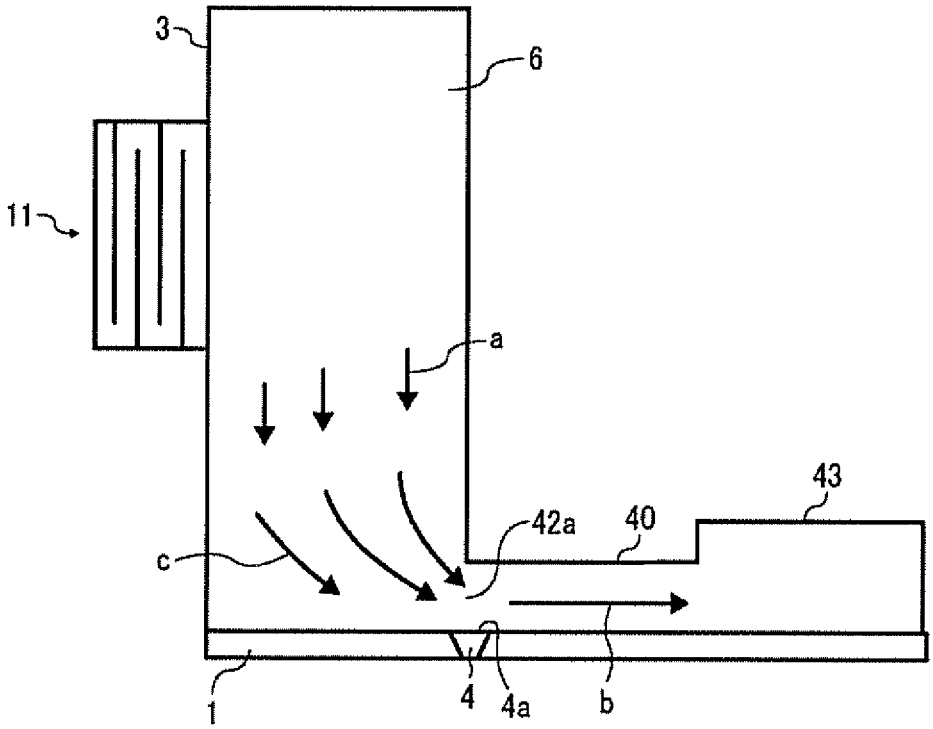
FIG. 13 is an illustration of a portion of the liquid discharge head according to an eighth embodiment of the present disclosure.

Nest, the liquid discharge head according to an eighth embodiment of the present disclosure is described with reference to FIG. 13. FIG. 13 is an illustration of a portion of the liquid discharge head according to the eighth embodiment.

In the eighth embodiment, the liquid-inflow-side opening 42*a* of the circulation-channel-side fluid restrictor 42 as the circulation channel is communicated with a side wall of the individual liquid chamber 6.

In the eighth embodiment, the first direction a represents a direction of flow of liquid in the individual liquid chamber 6, indicated by arrow a in FIG. 13. The second direction b represents a direction of flow of liquid in the circulation-channel-side fluid restrictor 42, indicated by arrow bin FIG. 13. The first direction a crosses the second direction b. In the eighth embodiment, the individual liquid chamber 6 and the circulation-channel-side fluid restrictor 42 are disposed so that the first direction a is perpendicular to the second direction b.

A portion of the liquid-inflow-side opening 4*a* of the nozzle 4 opposes the individual liquid chamber 6, and the remainder portion of the liquid-inflow-side opening 4*a* opposes the circulation-channel-side fluid restrictor 42.

In the eighth embodiment, the length of the circulation-channel-side fluid restrictor 42 in the second direction b is longer than the diameter of the liquid-inflow-side opening 4*a* of the nozzle 4. Accordingly, when the direction of flow of liquid is turned from the first direction a to the second direction b crossing the first direction a, the cross-sectional area of the channel decreases, thus increasing the speed of flow.

Such a configuration facilitates flowing of liquid into the nozzle 4, of which the liquid-inflow-side opening 4*a* opposes the circulation-channel-side fluid restrictor 42, thus facilitating stirring of liquid in the nozzle 4.

Figure 14:
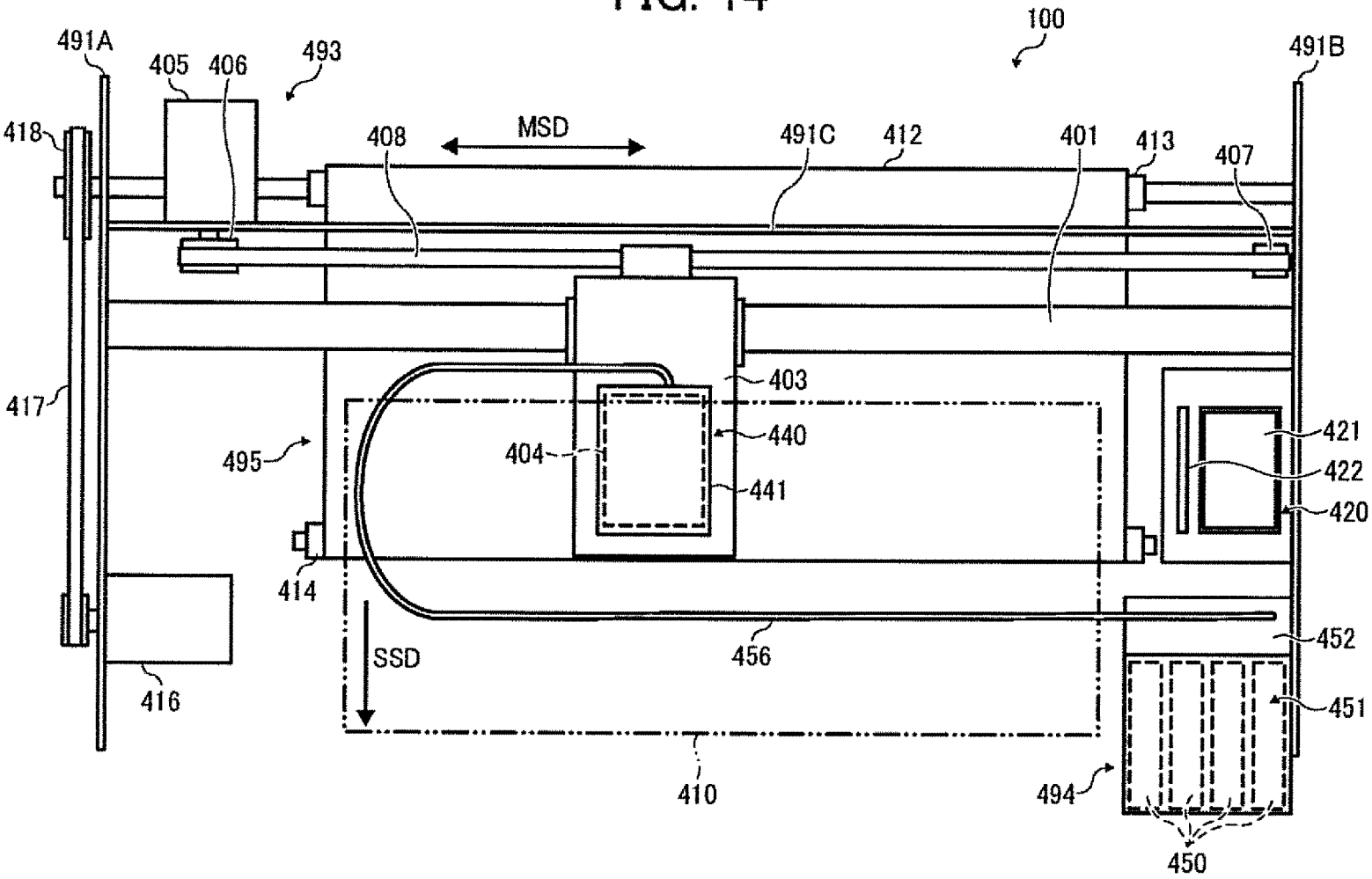
FIG. 14 is a plan view of a portion of a liquid discharge apparatus according to an embodiment of the present disclosure.
Figure 15:
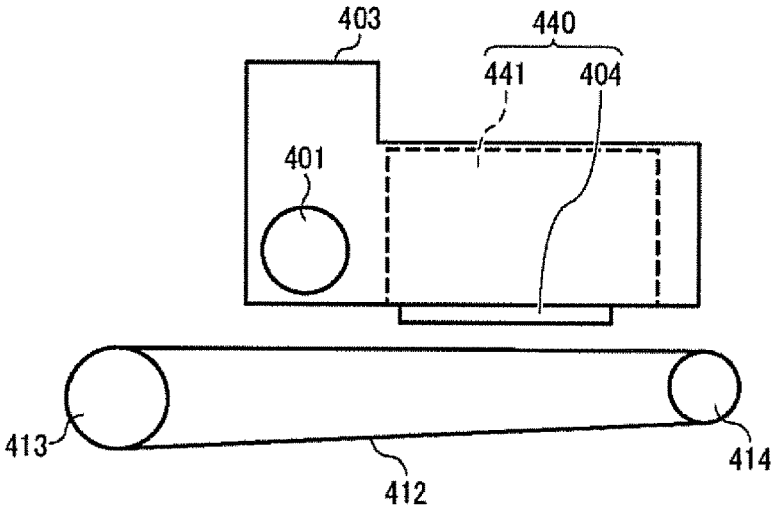
FIG. 15 is a side view of the liquid discharge apparatus of FIG. 14.

Next, a liquid discharge apparatus according to an embodiment of the present disclosure is described with reference to FIGS. 14 and 15. FIG. 14 is a plan view of a portion of the liquid discharge apparatus according to an embodiment of the present disclosure. FIG. 15 is a side view of a portion of the liquid discharge apparatus of FIG. 14.

A liquid discharge apparatus 100 according to the present embodiment is a serial-type apparatus in which a main scan moving unit 493 reciprocally moves a carriage 403 in a main scanning direction indicated by arrow MSD in FIG. 14. The main scan moving unit 493 includes, e.g., a guide 401, a main scanning motor 405, and a timing belt 408. The guide 401 is laterally bridged between a left side plate 491A and a right side plate 491B and supports the carriage 403 so that the carriage 403 is movable along the guide 401. The main scanning motor 405 reciprocally moves the carriage 403 in the main scanning direction MSD via the timing belt 408 laterally bridged between a drive pulley 406 and a driven pulley 407.

The carriage 403 mounts a liquid discharge device 440 in which the liquid discharge head 404 and a head tank 441 are integrated as a single unit. The liquid discharge head 404 of the liquid discharge device 440 discharges ink droplets of respective colors of yellow (Y), cyan (C), magenta (M), and black (K). The liquid discharge head 404 includes nozzle rows, each including a plurality of nozzles 4 arrayed in row in a sub-scanning direction, which is indicated by arrow SSD in FIG. 14, perpendicular to the main scanning direction MSD. The liquid discharge head 404 is mounted to the carriage 403 so that ink droplets are discharged downward.

The liquid stored outside the liquid discharge head 404 is supplied to the liquid discharge head 404 via a supply unit 494 that supplies the liquid from a liquid cartridge 450 to the head tank 441.

The supply unit 494 includes, e.g., a cartridge holder 451 as a mount part to mount liquid cartridges 450, a tube 456, and a liquid feed unit 452 including a liquid feed pump. The liquid cartridges 450 are detachably mounted to the cartridge holder 451. The liquid is supplied to the head tank 441 by the liquid feed unit 452 via the tube 456 from the liquid cartridges 450.

The liquid discharge apparatus 100 includes a conveyance unit 495 to convey a sheet 410. The conveyance unit 495 includes a conveyance belt 412 as a conveyor and a sub-scanning motor 416 to drive the conveyance belt 412.

The conveyance belt 412 electrostatically attracts the sheet 410 and conveys the sheet 410 at a position facing the liquid discharge head 404. The conveyance belt 412 is an endless belt and is stretched between a conveyance roller 413 and a tension roller 414. The sheet 410 is attracted to the conveyance belt 412 by electrostatic force or air aspiration.

The conveyance roller 413 is driven and rotated by the sub-scanning motor 416 via a timing belt 417 and a timing pulley 418, so that the conveyance belt 412 circulates in the sub-scanning direction SSD.

At one side in the main scanning direction MSD of the carriage 403, a maintenance unit 420 to maintain and recover the liquid discharge head 404 in good condition is disposed on a lateral side of the conveyance belt 412.

The maintenance unit 420 includes, for example, a cap 421 to cap a nozzle face (i.e., a face on which the nozzles are formed) of the liquid discharge head 404 and a wiper 422 to wipe the nozzle face.

The main scan moving unit 493, the supply unit 494, the maintenance unit 420, and the conveyance unit 495 are mounted to a housing that includes the left side plate 491A, the right side plate 491B, and a rear side plate 491C.

In the liquid discharge apparatus 100 thus configured, the sheet 410 is conveyed on and attracted to the conveyance belt 412 and is conveyed in the sub-scanning direction SSD by the cyclic rotation of the conveyance belt 412.

The liquid discharge head 404 is driven in response to image signals while the carriage 403 moves in the main scanning direction MSD, to discharge liquid to the sheet 410 stopped, thus forming an image on the sheet 410.

As described above, the liquid discharge apparatus 100 includes the liquid discharge head 404 according to an embodiment of the present disclosure, thus allowing stable formation of high quality images.

Figure 16:
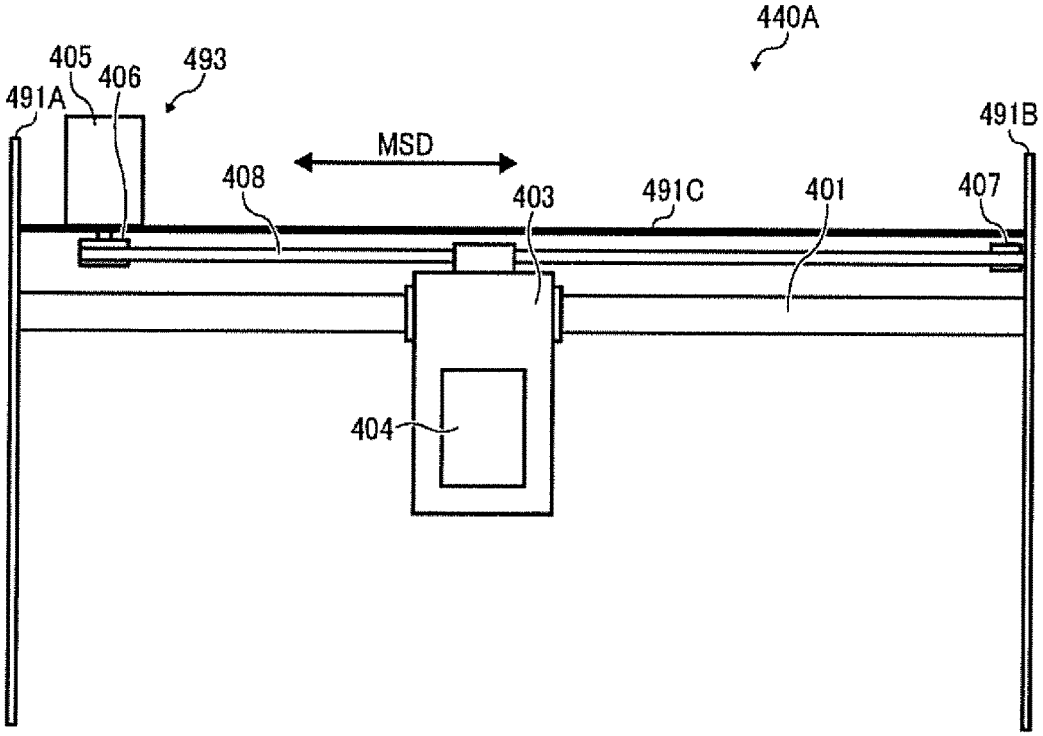
FIG. 16 is a plan view of a portion of the liquid discharge device according to another embodiment of the present disclosure.

Next, another example of the liquid discharge device according to an embodiment of the present disclosure is described with reference to FIG. 16. FIG. 16 is a plan view of a portion of another example of the liquid discharge device (liquid discharge device 440A).

The liquid discharge device 440A includes the housing, the main scan moving unit 493, the carriage 403, and the liquid discharge head 404 among components of the liquid discharge apparatus 100. The left side plate 491A, the right side plate 491B, and the rear side plate 491C constitute the housing.

Note that, in the liquid discharge device 440A, at least one of the maintenance unit 420 and the supply unit 494 may be mounted on, for example, the right side plate 491B.

Figure 17:
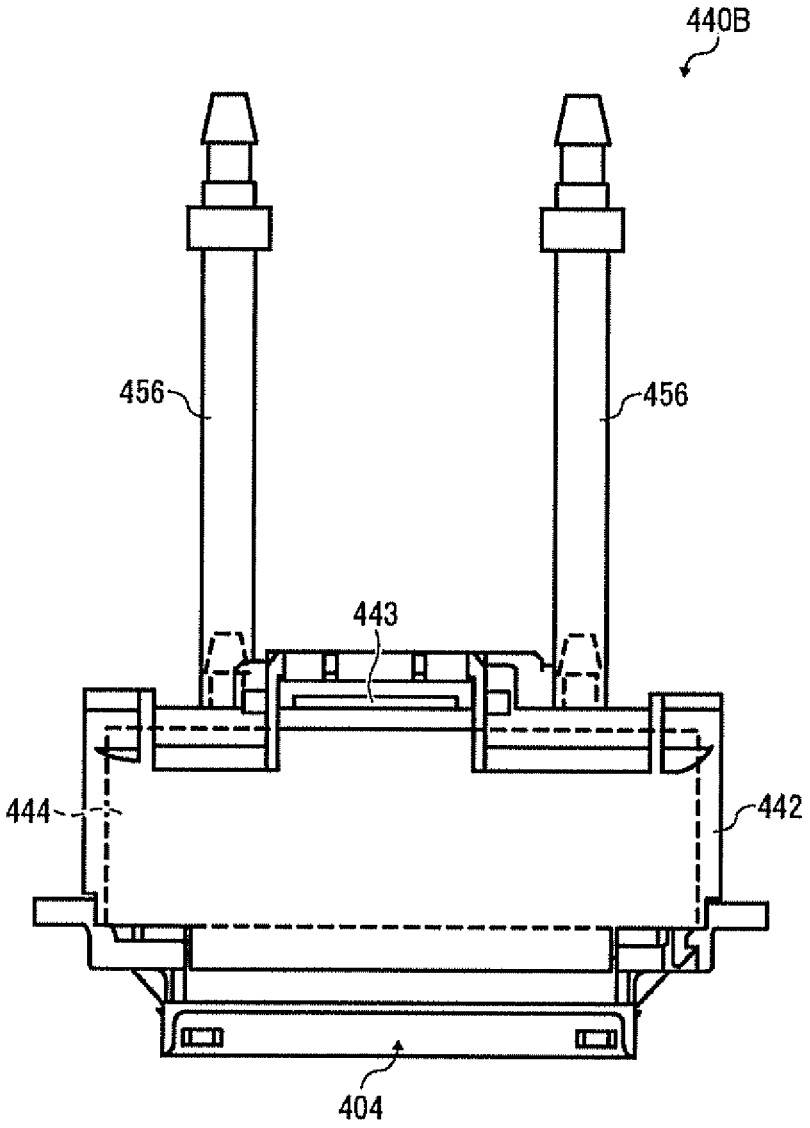
FIG. 17 is a front view of the liquid discharge device according to still another embodiment of the present disclosure.

Next, still another example of the liquid discharge device according to an embodiment of the present disclosure is described with reference to FIG. 17. FIG. 17 is a front view of still another example of the liquid discharge device (liquid discharge device 440B).

The liquid discharge device 440B includes the liquid discharge head 404 to which a channel part 444 is mounted, and the tube 456 connected to the channel part 444.

Further, the channel part 444 is disposed inside a cover 442. Instead of the channel part 444, the liquid discharge device 440B may include the head tank 441. A connector 443 to electrically connect the liquid discharge head 404 to a power source is disposed above the channel part 444.

Figure 18:
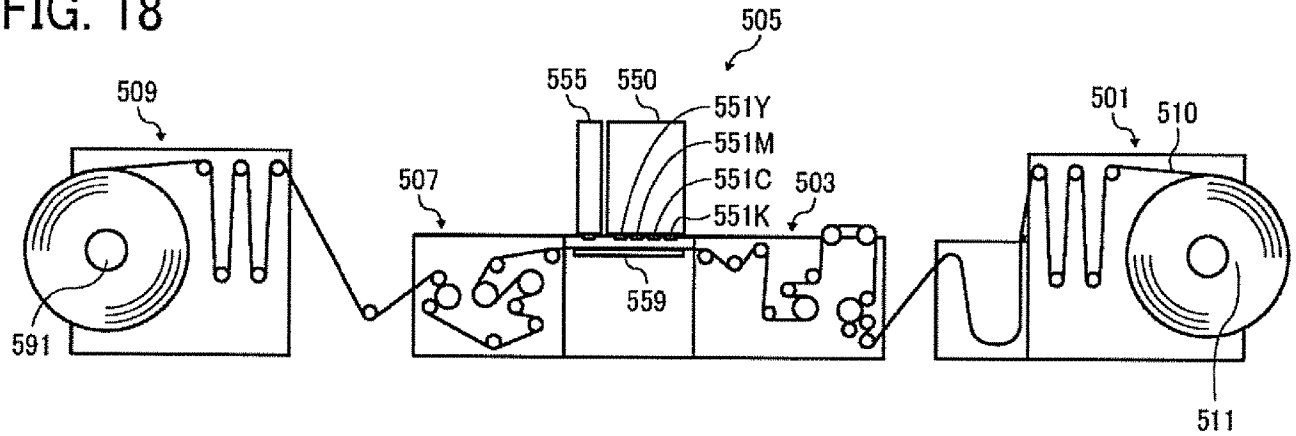
FIG. 18 is an illustration of the liquid discharge apparatus according to another embodiment of the present disclosure.
Figure 19:
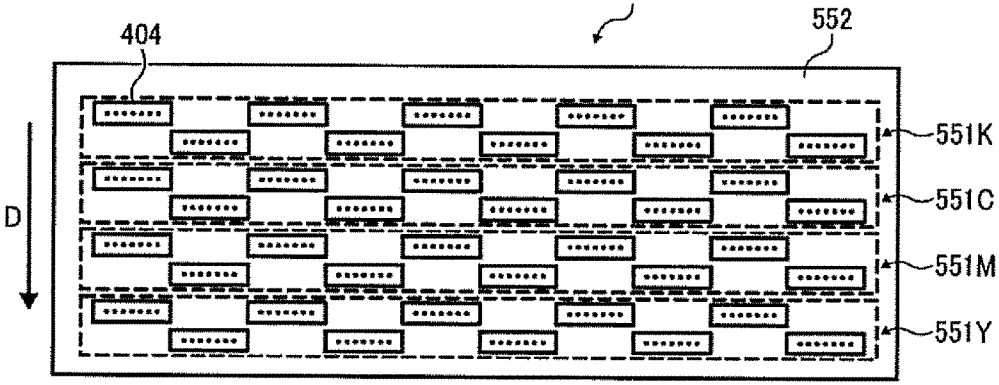
FIG. 19 is a plan view of a head unit of the liquid discharge apparatus of FIG. 18 according to an embodiment of the present disclosure.

Next, another example of the liquid discharge apparatus according to an embodiment of the present disclosure is described with reference to FIGS. 18 and 19. FIG. 18 is an illustration of the liquid discharge apparatus according to an embodiment of the present disclosure. FIG. 19 is a plan view of a head unit of the liquid discharge apparatus.

The liquid discharge apparatus 100 includes a feeder 501 to feed a continuous medium 510, a guide conveyor 503 to guide and convey the continuous medium 510, fed from the feeder 501, to a printing unit 505, the printing unit 505 to discharge liquid onto the continuous medium 510 to form an image on the continuous medium 510, a drier unit 507 to dry the continuous medium 510, and an ejector 509 to eject the continuous medium 510.

The continuous medium 510 is fed from a root winding roller 511 of the feeder 501, guided and conveyed with rollers of the feeder 501, the guide conveyor 503, the drier unit 507, and the ejector 509, and wound around a winding roller 591 of the ejector 509.

In the printing unit 505, the continuous medium 510 is conveyed opposite a first head unit 550 and a. second head unit 555 on a conveyance guide 559. The first head unit 550 discharges liquid to form an image on the continuous medium 510. Post-treatment is performed on the continuous medium 510 with treatment liquid discharged from the second head unit 555.

Here, the first head unit 550 includes, for example, four-color full-line head arrays 551K, 551C, 551M, and 551Y (hereinafter, collectively referred to as "head arrays 551" unless colors are distinguished) from an upstream side in a feed direction of the continuous medium 510 (hereinafter. "medium feed direction") indicated by arrow D in FIG. 19.

The head arrays 551K, 551C, 551M, and 551Y are liquid dischargers to discharge liquid of black (K), cyan (C), magenta (M), and yellow (Y) onto the continuous medium 510. It is to be noted that the number and types of color is not limited to the above-described four colors of K, C, M, and Y and may be any other suitable number and types.

In each head array 551, for example, as illustrated in FIG. 19, a plurality of liquid discharge heads (also referred to as simply "heads") 404 is arranged in a staggered manner on a base 552 to form the head array. Noted that the configuration of the head array 551 is not limited to such a configuration.

Figure 20:
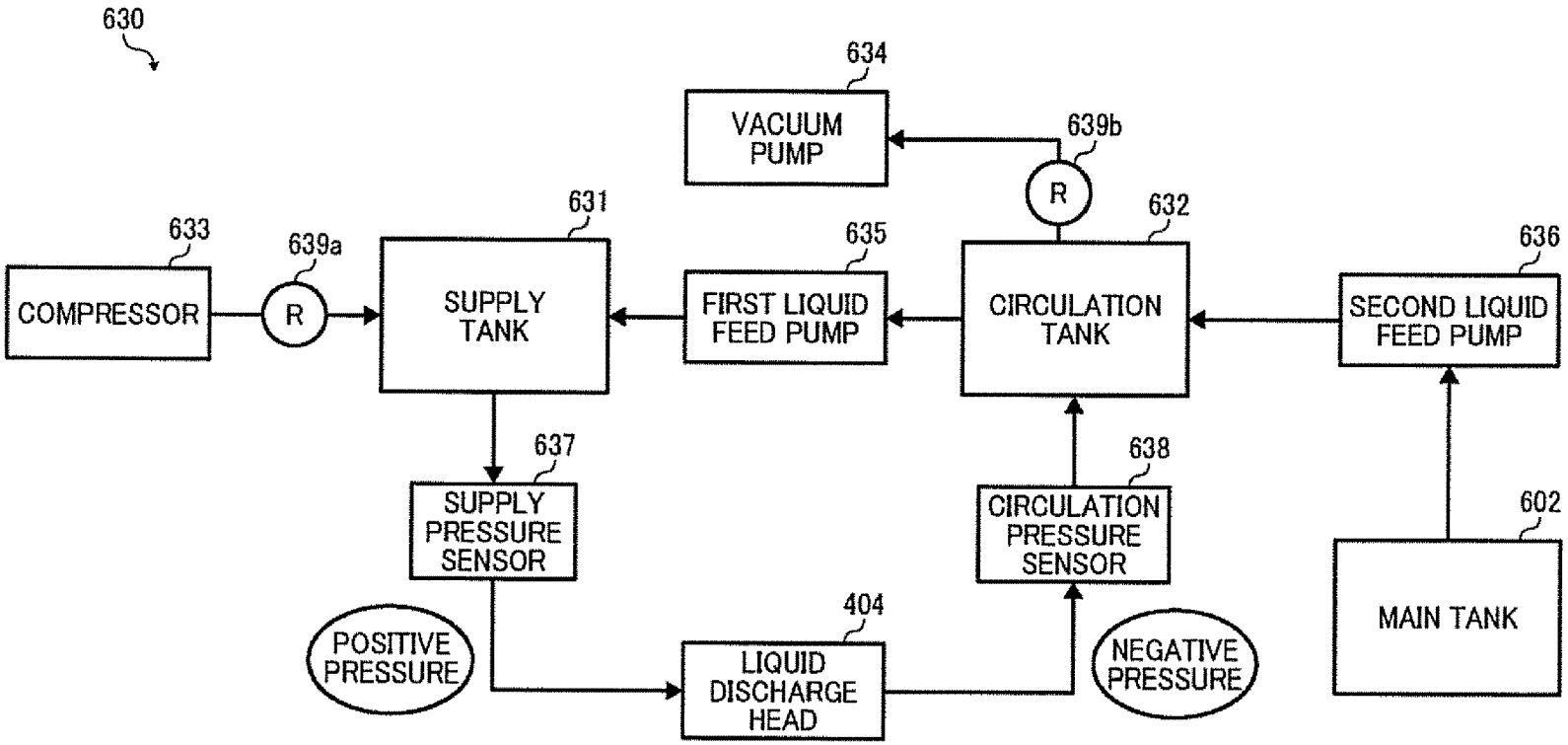
FIG. 20 is a block diagram of a liquid circulation system of the liquid discharge apparatus of FIG. 18 according to an embodiment of the present disclosure.

Next, an example of a liquid circulation system according to an embodiment of the present disclosure is described with reference to FIG. 20. FIG. 20 is a block diagram of the liquid circulation system according to an embodiment of the present disclosure.

A liquid circulation system 630 illustrated in FIG. 20 includes, e.g., a main tank 602, the liquid discharge head 404, a supply tank 631, a circulation tank 632, a compressor 633, a vacuum pump 634, a first liquid feed pump 635, a second liquid feed pump 636, a supply pressure sensor 637, a circulation pressure sensor 638, a regulator (R) 639*a*, and a regulator (R) 639*b*.

The supply pressure sensor 637 is disposed between the supply tank 631 and the liquid discharge head 404 and connected to a supply channel side connected to the supply ports 23 (see FIG. 1) of the liquid discharge head 404. The circulation pressure sensor 638 is disposed between the liquid discharge head 404 and the circulation tank 632 and is connected to a circulation channel side connected to the circulation ports 46 (see FIG. 1) of the liquid discharge head 404.

One end of the circulation tank 632 is connected to the supply tank 631 via the first liquid feed pump 635 and the other end of the circulation tank 632 is connected to the main tank 602 via the second liquid feed pump 636.

Thus, liquid is flown from the supply tank 631 into the liquid discharge head 404 through the supply ports 23 and output from the circulation ports 46 to the circulation tank 632. Further, the first liquid feed pump 635 feeds liquid from the circulation tank 632 to the supply tank 631, thus circulating liquid.

The supply tank 631 is connected to the compressor 633 and controlled so that a predetermined positive pressure is detected with the supply pressure sensor 637. The circulation tank 632 is connected to the vacuum pump 634 and controlled so that a predetermined negative pressure is detected with the circulation pressure sensor 638.

Such a configuration allows the menisci of ink to be maintained at a constant negative pressure while circulating ink through the inside of the liquid discharge head 404.

When droplets are discharged from the nozzles 4 of the liquid discharge head 404, the amount of liquid in each of the supply tank 631 and the circulation tank 632 decreases. Hence, the second liquid feed pump 636 replenishes liquid from the main tank 602 to the circulation tank 632. The replenishment of liquid from the main tank 602 to the circulation tank 632 is controlled in accordance with a result of detection with, e.g., a liquid level sensor in the circulation tank 632, for example, in a manner in which liquid is replenished when the liquid level of liquid in the circulation tank 632 is lower than a predetermined height.

In the above-described embodiments of the present disclosure, the liquid discharge apparatus includes the liquid discharge head or the liquid discharge device, and drives the liquid discharge head to discharge liquid. The liquid discharge apparatus may be, for example, an apparatus capable of discharging liquid to a material to which liquid can adhere and an apparatus to discharge liquid toward gas or into liquid.

The liquid discharge apparatus may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The liquid discharge apparatus may be, for example, an image forming apparatus to discharge liquid to form an image on a medium or a solid fabricating apparatus (three-dimensional fabricating apparatus) to discharge a fabrication liquid to a powder layer in which powder is formed in layers to form a solid fabricating object (three-dimensional object).

The liquid discharge apparatus is not limited to an apparatus to discharge liquid to visualize meaningful images, such as letters or figures. For example, the liquid discharge apparatus may be an apparatus to form meaningless images, such as meaningless patterns, or fabricate three-dimensional images.

The above-described material to which liquid can adhere may include any material to which liquid may adhere even temporarily. The material to which liquid can adhere may be, e.g., paper, thread, fiber, fabric, leather, metal, plastics, glass, wood, and ceramics, to which liquid can adhere even temporarily.

The liquid may be, e.g., ink, treatment liquid, DNA sample, resist, pattern material, binder, and mold liquid.

The liquid discharge apparatus may be, unless in particular limited, any of a serial-type apparatus to move the liquid discharge head and a line-type apparatus not to move the liquid discharge head.

The liquid discharge apparatus may be, for example, a treatment liquid coating apparatus to discharge a treatment liquid to a sheet to coat the treatment liquid on the surface of the sheet to reform the sheet surface and an injection granulation apparatus in which a composition liquid including raw materials dispersed in a solution is injected through nozzles to granulate fine particles of the raw materials.

The liquid discharge device is an integrated unit including the liquid discharge head and a functional part(s) or unit(s), and is an assembly of parts relating to liquid discharge. For example, the liquid discharge device may be a combination of the liquid discharge head with at least one of the head tank, the carriage, the supply unit, the maintenance unit, and the main scan moving unit.

Here, the integrated unit may be, for example, a combination in which the liquid discharge head and a functional part(s) are secured to each other through, e.g., fastening, bonding, or engaging, and a combination in which one of the liquid discharge head and a functional part(s) is movably held by another. The liquid discharge head may be detachably attached to the functional part(s) or unit(s) s each other.

The liquid discharge device may be, for example, a liquid discharge device in which the liquid discharge head and the head tank are integrated as a single unit, such as the liquid discharge device 440 illustrated in FIG. 15. The liquid discharge head and the head tank may be connected each other via, e.g., a tube to form the liquid discharge device as the integrated unit. Here, a unit including a filter may further be added to a portion between the head tank and the liquid discharge head.

In another example, the liquid discharge device may be an integrated unit in which a liquid discharge head is integrated with a carriage.

In still another example, the liquid discharge device may be the liquid discharge head movably held by the guide that forms part of the main scan moving unit, so that the liquid discharge head and the main scan moving unit are integrated as a single unit. Like the liquid discharge device 440A illustrated in FIG. 16, the liquid discharge device may be an integrated unit in which the liquid discharge head, the carriage, and the main scan moving unit are integrally formed as a single unit.

In another example, the cap that forms part of the maintenance unit is secured to the carriage mounting the liquid discharge head so that the liquid discharge head, the carriage, and the maintenance unit are integrated as a single unit to form the liquid discharge device.

Like the liquid discharge device 440B illustrated in FIG. 17, the liquid discharge device may be an integrated unit in which the tube is connected to the liquid discharge head mounting the head tank or the channel part so that the liquid discharge head and the supply unit are integrally formed.

The main-scan moving unit may be a guide only. The supply unit may be a tube(s) only or a loading unit only.

The pressure generator used in the liquid discharge head is not limited to a particular-type of pressure generator. The pressure generator is not limited to the piezoelectric actuator (or a layered-type piezoelectric element) described in the above-described embodiments, and may be, for example, a thermal actuator that employs a thermoelectric conversion element, such as a thermal resistor or an electrostatic actuator including a diaphragm and opposed electrodes.

The terms "image formation", "recording", "printing", "image printing", and "molding" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:

a nozzle to discharge liquid in a discharge direction;

an individual liquid chamber communicated with the nozzle;

a nozzle passage to connect the individual liquid chamber to a liquid-inflow-side opening of the nozzle;

a circulation channel communicated with the individual liquid chamber; and an interfacial boundary portion disposed between, and to connect, the nozzle passage and the circulation channel, the interfacial boundary portion in its entirety facing the liquid-inflow-side opening of the nozzle, wherein a first direction in which liquid flows in the individual liquid chamber in parallel to the discharge direction is perpendicular to a second direction in which the circulation channel extends longitudinally and in which liquid flows in the circulation channel, and wherein liquid flow changes from the first direction to the second direction in the interfacial boundary portion facing, in a direction parallel to the discharge direction, the liquid-inflow-side opening of the nozzle.

2. The liquid discharge head according to claim 1, wherein the area that the liquid-inflow-side opening of the nozzle faces includes an area in which all liquid flows in the second direction.

3. The liquid discharge head according to claim 1, wherein a cross sectional area of the circulation channel is smaller than a cross sectional area of a channel from the individual liquid chamber to the nozzle.

4. The liquid discharge head according to claim 1, wherein the circulation channel includes a circulation-channel-side fluid restrictor downstream from the nozzle in the second direction, and wherein a fluid resistance of the nozzle is smaller than a fluid resistance of the circulation-channel-side fluid restrictor.

5. A liquid discharge device comprising the liquid discharge head according to claim 1 to discharge liquid.

6. The liquid discharge device according to claim 5, wherein the liquid discharge head is integrated as a single unit with at least one of:

a head tank to store liquid to be supplied to the liquid discharge head;

a carriage mounting the liquid discharge head;

a supply unit to supply liquid to the liquid discharge head;

a maintenance unit to maintain and recover the liquid discharge head; and a main scan moving unit to move the liquid discharge head in a main scanning direction.

7. A liquid discharge apparatus comprising the liquid discharge device according to claim 5 to discharge liquid.

8. A liquid discharge apparatus comprising the liquid discharge head according to claim 1 to discharge liquid.

9. A liquid discharge head comprising:

a nozzle to discharge liquid in a discharge direction;

an individual liquid chamber communicated with the nozzle;

a nozzle passage connecting the individual liquid chamber to a liquid-inflow-side opening of the nozzle;

a circulation channel communicated with the nozzle passage; and an interfacial boundary portion disposed between, and to connect, the nozzle passage and the circulation channel, the interfacial boundary portion in its entirety facing the liquid-inflow-side opening of the nozzle, wherein a first direction in which liquid flows in parallel to the discharge direction to the nozzle passage is perpendicular to a second direction in which the circulation channel extends longitudinally and in which liquid flows in the circulation channel, wherein liquid flow changes from the first direction to the second direction in the interfacial boundary portion facing, in a direction parallel to the discharge direction, the liquid-inflow-side opening of the nozzle, and wherein a portion of the liquid-inflow-side opening of the nozzle opposes the nozzle passage.

10. The liquid discharge head according to claim 9, wherein a cross sectional area of the circulation channel is smaller than a cross sectional area of a channel from the individual liquid chamber to the nozzle.

11. The liquid discharge head according to claim 9, wherein the circulation channel includes a circulation-channel-side fluid restrictor downstream from the nozzle in the second direction, and wherein a fluid resistance of the nozzle is smaller than a fluid resistance of the circulation-channel-side fluid restrictor.

12. A liquid discharge device comprising:

the liquid discharge head according to claim 9 to discharge liquid; and a maintenance unit to maintain and recover the liquid discharge head.

13. A liquid discharge apparatus comprising:

the liquid discharge head according to claim 9 to discharge liquid; and a carriage mounting the liquid discharge head.

* * * * *